US005379918A

United States Patent [19]

Goto

[11] Patent Number: 5,379,918

[45] Date of Patent: Jan. 10, 1995

[54] COUPLING WITH A VALVE FOR DISPENSING LIQUIDS

[75] Inventor: Kunihiko Goto, Tokyo, Japan

[73] Assignee: Nitto Kohki Co., Ltd., Tokyo, Japan

[21] Appl. No.: 77,453

[22] Filed: Jun. 17, 1993

[30] Foreign Application Priority Data

Jun. 19, 1992 [JP] Japan ..... 4-049100[U]

[51] Int. Cl.[6] ..... B67D 5/00

[52] U.S. Cl. ..... 222/82; 222/83.5; 222/88; 222/153

[58] Field of Search ..... 222/80, 81, 82, 83, 222/83.5, 88, 89, 153, 335

[56] References Cited

U.S. PATENT DOCUMENTS

| | | | |
|---|---|---|---|
| 3,752,366 | 8/1973 | Lawrence, Jr. | 222/335 X |
| 4,137,930 | 2/1979 | Scholle | 222/83 X |
| 4,375,864 | 3/1983 | Savage | 222/81 |
| 4,493,438 | 1/1985 | Rutter | 222/153 X |
| 4,598,731 | 6/1986 | Colson | 222/83 X |
| 4,881,662 | 11/1989 | Tallman | 222/81 |
| 4,948,014 | 8/1990 | Rutter et al. | 222/83 |

FOREIGN PATENT DOCUMENTS

| | | | |
|---|---|---|---|
| 3533241C1 | 5/1987 | Germany . | |
| 62-171438 | 10/1987 | Japan . | |
| 2077243 | 12/1981 | United Kingdom | 222/81 |

*Primary Examiner*—Andres Kashnikow
*Assistant Examiner*—Joseph A. Kaufman
*Attorney, Agent, or Firm*—Nixon & Vanderhye

[57] ABSTRACT

A coupling including a plug attached to a sealed container and having an opening, and a socket having a cutter section for breaking a thin film for sealing the opening when the plug is connected to the socket. The plug has an engagement groove formed in an outer periphery of a plug cylinder, and the socket includes a socket outer cylinder having a lock engageable with the engaging groove, and a socket inner cylinder which is engaged with a smaller-diameter portion of the outer cylinder and is axially movable within the socket outer cylinder. Stoppers are provided within an annular space defined between the socket inner cylinder and the socket outer cylinder. The stopper restricts forward movement of the socket inner cylinder in the state in which the socket is separated from the plug, and the stopper fixes the lock in the state in which the socket is connected to the plug.

5 Claims, 3 Drawing Sheets

COUPLING WITH A VALVE FOR DISPENSING LIQUIDS

BACKGROUND OF THE INVENTION

1. Field of the Invention

The present invention relates to a coupling wherein a thin film 16 for sealing an opening 15 of a plug 10 attached to a sealed container 12 is broken by a cutter 34 provided on a socket 20 when the plug 10 is connected to the socket 20.

2. Description of the Related Art

There have conventionally been known automatic vending machines or manual suction machines of the bag-in-box type (hereinafter referred to as "BIB type") in which plastic-made flexible containers filled with drinks such as coffee and juice are transported in boxes made of corrugated cardboard.

According to the machines of the BIB type, there is no need to collect empty containers, unlike the prior art. Thus, the running cost of the machines can be reduced, and an excellent sanitary condition can be maintained since the fluid in the container is not exposed to the air.

Japanese Utility Model Disclosure Hei 3-93687 filed by the applicant of the present application discloses a coupling employed to remove by suction fluid filled in the container.

This coupling comprises:

- a plug attached to a sealed container and provided with an opening; and
- a socket engaged with the plug and accommodating a valve,
- wherein the plug has an annular projection formed on an outer peripheral surface of a main cylinder of the plug,
- the socket has a cutter section for breaking a thin film for sealing the opening of the plug, when the socket is connected to the plug, and a sleeve rotatably engaged with an outer peripheral surface of a main cylinder of the socket,
- the outer peripheral portion of the socket is provided with a lock ring situated in a direction perpendicular to the axis of the socket and straddling the axis of the socket, the lock ring having a free end portion projecting from the outer peripheral portion of the socket via a compression coil spring, and
- the inner peripheral portion of the lock ring is provided with a projection engageable with the annular projection from the side face of the annular projection.

This coupling, however, has a problem in that a high resistance occurs when the plug is connected to the socket, and, in particular, a sliding resistance of an O-ring for sealing between the inner peripheral surface of the plug and the outer peripheral surface of the socket is high. Consequently, the coupling between the plug and socket cannot smoothly be performed.

SUMMARY OF THE INVENTION

An object of the present invention is to provide a coupling capable of smoothly performing a coupling operation, despite a sliding resistance of the O-ring.

Another object of the invention is to provide a coupling wherein in the non-coupled state the socket inner cylinder is prevented from moving forward relative to the socket outer cylinder, so that a cutter section provided at the front end portion of the socket inner cylinder can be protected from contact with the outside.

In order to achieve the above objects, there is provided a coupling comprising a plug 10 attached to a sealed container 12 and having an opening 15, and a socket 20 having a cutter section 34 for breaking a thin film 16 for sealing the opening 15 when the plug 10 is connected to the socket 20. The plug 10 has an engagement groove 17 formed in an outer periphery of a plug cylinder 14, and the socket 20 comprises a socket outer cylinder 40 having lock means 44 engageable with the engaging groove 17, and a socket inner cylinder 30 which is engaged with a smaller-diameter portion of the outer cylinder 40 and is axially movable within the socket outer cylinder 40. Stoppers (60, 70) are provided within an annular space 38 defined between the socket inner cylinder 30 and the socket outer cylinder 40. The stopper 70 restricts forward movement of the socket inner cylinder 30 in the state in which the socket 20 is separated from the plug 10, and the stopper 60 fixes the lock means 44 in the state in which the socket 20 is connected to the plug 10.

When the socket 20 is connected to the plug 10, the socket 20 and plug 10 are made to face each other and the front end portion 13 of the plug cylinder 14 is inserted into the annular space 38 defined between the socket inner cylinder 30 and socket outer cylinder 40, following which the plug cylinder 14 is coupled to the socket outer cylinder 40 by the lock means 44. Then, the socket inner cylinder 30 is moved forward axially within the socket outer cylinder 40. Thus, the cutter section 34 provided at the front end portion of the socket inner cylinder 30 breaks the thin film 16 of the plug 10 and a fluid passageway is opened.

In this state, since the stopper 60 restricts the lock means 44, the plug 10 is not separated from the socket 20.

When the plug 10 is disconnected from the socket 20, the socket inner cylinder 30 is rotated in a direction reverse to the direction in which the inner cylinder 30 is rotated to couple the plug 10 and socket 20, and the socket inner cylinder 30 is retreated. Since the stopper 60 releases the restriction of the lock means 44, the socket 20 can be withdrawn from the plug 10. In this disconnected state, the socket inner cylinder 30 is stopped at the rearmost position relative to the socket outer cylinder 40. Therefore, the cutter section 34 is surrounded by the socket outer cylinder 40 and protected from the outside.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will now be described with reference to the accompanying drawings.

Figure 5:
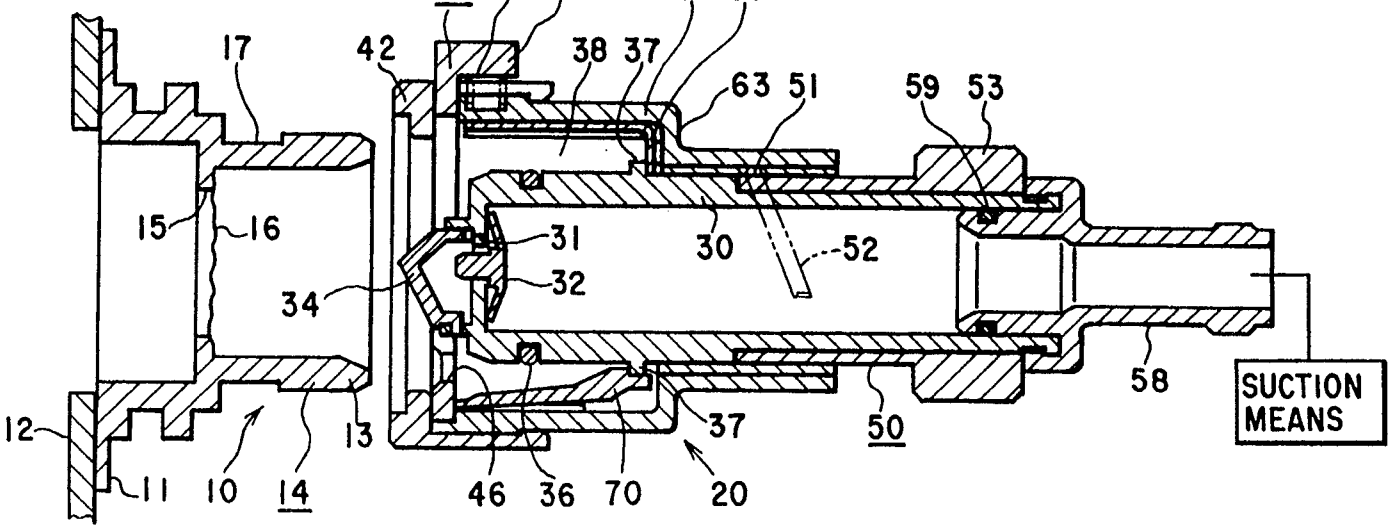
FIG. 5 is a vertical cross-sectional side view showing a state in which the socket is separated from the plug.

FIG. 5 is a vertical cross-sectional side view showing a separated state of a coupling in which a valve is housed in a socket. In the following description, the mutually facing portions of a plug 10 and a socket 20 are termed "front portions", "front end portions", etc., and the opposite-side portions thereof are called "rear portions", "rear end portions", etc.

A plug 10 (on the left-hand part of FIG. 5) has a rear end portion 11 attached to a sealed container 12. A front end portion 13 thereof is formed as a plug cylinder 14 engageable with the socket 20. An opening 15 having a predetermined caliber is formed at a substantially middle portion of the plug cylinder 15 in its axial direction. The opening 15 is closed by a thin film 16 which can relatively easily be broken by a sharp edge or the like. The thin film 16 is normally made of an aluminum foil, from the viewpoint of safety and sanitation.

An annular groove 17 is formed in an outer peripheral portion of the plug cylinder 14, which is located in rear of the front end portion 13.

On the other hand, a socket 20 has a main body constituted by a socket inner cylinder 30 and a socket outer cylinder 40 which are engageable, respectively, with an inner peripheral surface and an outer peripheral surface of the front end portion 13 of the plug cylinder 14. A cover ring 42 is detachably fitted on the front end portion of the outer cylinder 40. A lock ring 44, which is slidable in a direction perpendicular to the axis of the socket 20, is clamped in a gap defined between the front end portion and the cover ring 42.

The lock ring 44 has a pushing portion 45 at its upper part and an inwardly projecting engaging portion 46 at its lower part. The engaging portion 46 is engaged in the annular groove 17 of the plug cylinder 14, thereby constituting lock means.

A compression coil spring 48 is situated between the pushing portion 45 and the socket outer cylinder 40. The lock ring 44 is constantly urged upwards (in FIG. 5) by the force of the compression coil spring 48, thereby maintaining the lock state of the engaging portion 46 and annular groove 17. The lock state of the plug cylinder 14 and socket outer cylinder 40 is released by pushing the lock ring 44 against the force of the compression coil spring 48.

The front end portion of the socket inner cylinder 30 is sealed, except the portion in which a fluid passage hole 31 is formed. The fluid passage hole 31 can be sealed by a check valve 32 provided in rear of the hole 31, i.e. within the socket inner cylinder 30. A cutter section 34 having a tip portion shaped like a triangular pyramid is projected from the front end portion of the socket inner cylinder 30.

Figure 2:
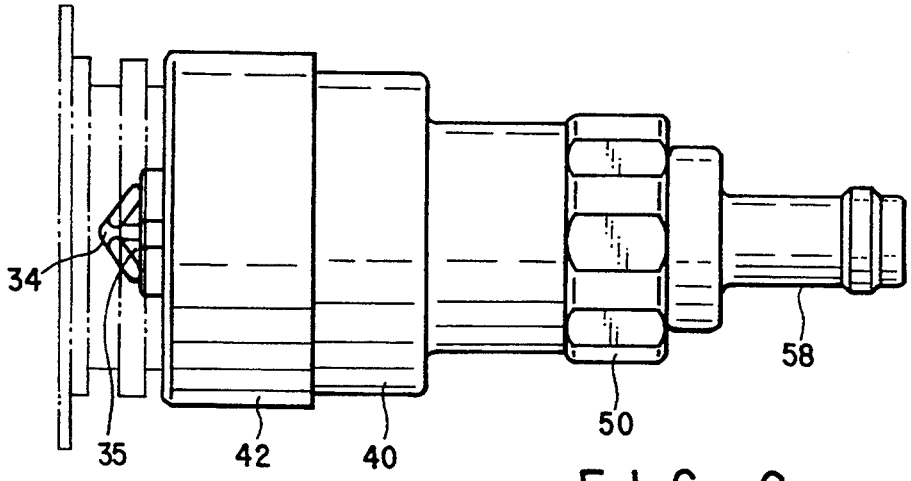
FIG. 2 is a bottom view of the socket 20 shown in FIG. 1.
Figure 3:
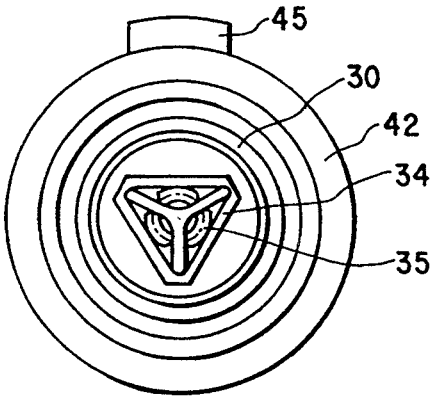
FIG. 3 is a front view of the socket 20 shown in FIG. 1.

The cutter section 34 has a passage hole 35 for passing a fluid through, as shown in FIGS. 2 and 3.

When the fluid flows from the plug 10 to the socket 20, the check valve 32 is retreated by the fluid pressure and/or a negative pressure created within the socket 20 by a conventional suction pump or the like. Thus, the passage hole 31 is opened so that the liquid filled in the container 12 can be sucked through the socket inner cylinder 30.

An O-ring 36 is mounted on an outer peripheral portion at the front portion of the socket inner cylinder 30. When the inner cylinder 30 is engaged with the plug cylinder 14, the O-ring 36 maintains sealing between the inner peripheral surface of the cylinder 14 and the outer peripheral surface of the inner cylinder 30. In addition, an annular projection 37 engageable with stoppers 60 and 70 is formed in rear of the O-ring 36.

The diameter of the rear part of the socket inner cylinder 30 is reduced, and an operational cylinder 50 is fitted on the outer periphery of the rear part of the inner cylinder 30. A hose nipple 58 is fitted on an outer peripheral portion of the rear part of the operational cylinder 50, thereby forming the operational cylinder 50 and inner cylinder 30 as one piece. The hose nipple 58 is connected to a suction pump via a conventional tube or the like (not shown). Another O-ring 59 is provided to maintain sealing between the inner peripheral surface of the socket inner cylinder 30 and the outer peripheral surface of the hose nipple 58.

The outer peripheral surface of the operational cylinder 50 is provided with a substantially semicircumferential male thread 51. The male thread 51 is engaged with a female thread 52 cut in an inner peripheral surface of a smaller-diameter rear part of the socket outer cylinder 40, so that the socket inner cylinder 30 can advance and retreat axially within the socket outer cylinder 40.

In this case, a larger-diameter portion 53 of the operational cylinder 50 determines the foremost position of the inner cylinder 30, and the annular projection 37 determines the rearmost position of the inner cylinder 30.

The stoppers 60 and 70 are provided within an annular space 38 defined between the socket inner cylinder 30 and socket outer cylinder 40.

Figure 6:
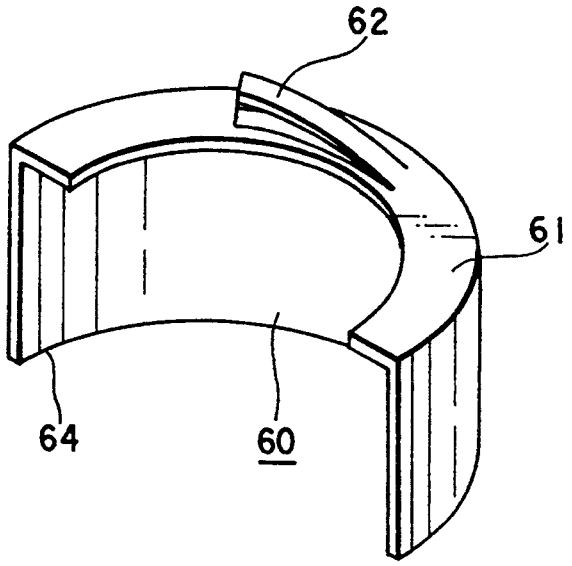
FIG. 6 is a perspective view of a stopper 60.

The stopper 60 has a semicylindrical shape, as shown in FIG. 6 (perspective view), and a rear end portion 61 situated within the annular space 38 is bent radially inward. The stopper 60 is formed of a slightly elastic plastic material, and a plate spring 62 is formed on the bent rear end portion 61.

The plate spring 62 abuts on the inner wall of a reduced-diameter portion 63 of the socket outer cylinder 40 so as to constantly urge the stopper 60 forwards. The plate spring 62 is engaged with the annular projection 37 formed on the outer peripheral surface of the socket inner cylinder 30 so that the plate spring 62 is not removed from the annular space 38.

Figure 1:
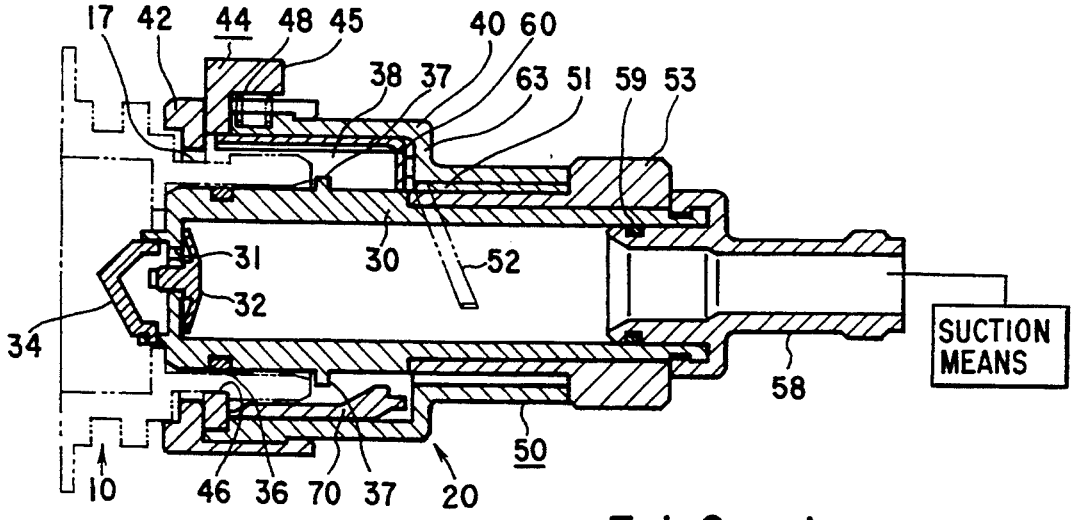
FIG. 1 is a vertical cross-sectional side view of a socket 20 in a state in which a plug is completely connected to the socket and a thin film is broken.

The axial length of the stopper 60 is determined such that in the connection state of the coupling shown in FIG. 1 a front end portion 64 of the stopper 60, which has moved forward, can restrict the vertical sliding motion of the lock ring 44.

Figure 7:
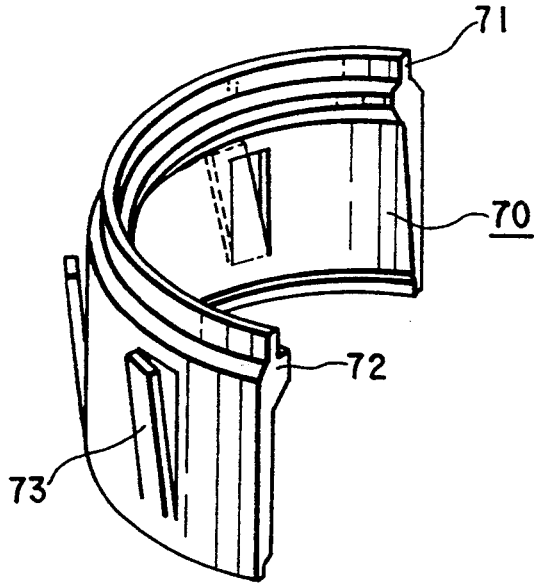
FIG. 7 is a perspective view of a stopper 70.

FIG. 7 is a perspective view of the stopper 70. The stopper 70, like the stopper 60, is formed of a plastic material in a semicylindrical shape. A stepped portion 72, which is engageable with the annular projection 37 when the socket 20 is separated from the plug 10, is formed on the inner peripheral portion of a rear end portion 71 of the stopper 70 situated within the annular space 38. A semicylindrical portion of the stopper 70 is provided with plate springs 73. The plate springs 73 are put in contact with the inner peripheral portion of the socket outer cylinder 40 and constantly urge the rear end portion 71 of the stopper 70 radially inwards.

The operation of the above embodiment will now be described.

When the socket 20 is connected to the plug 10 from the separated state of the coupling shown in FIG. 5, the front end portion of the socket inner cylinder 30 is inserted into the plug cylinder 14 and the front end portion 13 of the plug cylinder 14 is inserted into the annular space 38 of the socket 20, relative to the insertion motion of the inner cylinder 30.

In FIG. 5, the rear end portion 61 of the stopper 60 abuts on the annular projection 37 formed on the outer peripheral surface of the socket inner cylinder 30 and the stopper is located in the retreated position. Thus, the lock ring 44 is not restricted by the front end portion 64 of the stopper 60 and is in the free state. The front end portion 13 of the incoming plug cylinder 14 abuts on the side face of the engaging portion 46 of the lock ring 44 and lowers the ring 44.

Figure 4:
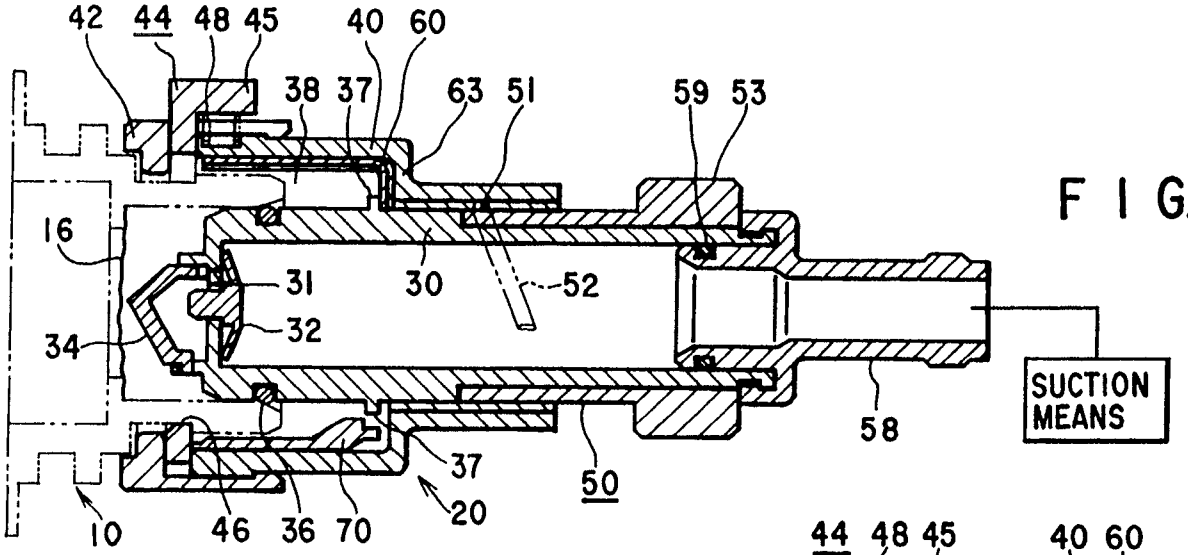
FIG. 4 is a vertical cross-sectional side view of the socket 20 in a state in which the plug is connected to the socket but the thin film has not yet been broken.

The front end portion 13 of the plug cylinder 14 further advances into the annular space 38. When the annular groove 17 of the plug cylinder 14 has reached a location facing the engaging portion 46 of the lock ring 44, the lock ring 44 is urged upwards by the compression coil spring 48 and the engaging portion 46 is engaged with the annular groove 17. FIG. 4 shows the locked state of the plug cylinder 14 and the socket outer cylinder 40 in this case.

In the state shown in FIG. 4, the front end portion 13 of the plug cylinder 14 presses the stopper 70 radially outwards. Thus, the rear end portion 71 of the stopper 70 is urged radially outwards against the force of the plate springs 73 and the stepped portion 72 of the stopper 70 is disengaged from the annular projection 37 of the socket inner cylinder 30. Accordingly, the engaged state of the socket inner cylinder 30 is released.

At this time, the socket inner cylinder 30 is permitted to advance within the socket outer cylinder 40. Thus, the larger-diameter portion 53 of the operational cylinder 50, which is formed as one piece with the socket inner cylinder 30, is manually rotated to move the socket inner cylinder 30 forward within the socket outer cylinder 40. As a result, the plug and socket are completely coupled, as shown in FIG. 1.

Specifically, the cutter section 34 of the socket inner cylinder 30 breaks the thin film 16 which seals the opening 15 of the plug cylinder 14, and the passage hole 35 of the cutter section 34 communicates with the sealed container 12.

If a vacuum is created within the socket 20 by actuating a suction pump or the like (not shown) which is connected via a tube or the like (not shown) to the hose nipple 58 coupled to the socket inner cylinder 30, the check valve 32 is retreated by the vacuum pressure and/or the fluid pressure of drink and the drink flows from the plug to the socket through the passage hole 31 of the front end portion of the socket inner cylinder 30.

In this state, the stopper 60 moves forward by a distance urged by the plate spring 62, and the front end portion 64 of the stopper 60 is moved inside the lock ring 44. Accordingly, downward movement of the lock ring 44 is prevented and the lock ring 44 is fixed. The plug 10 is not disconnected from the socket 20.

When the plug 10 is disconnected from the socket 20, the larger-diameter portion 53 of the operational cylinder 53 is manually rotated in a direction opposite to the direction in which the portion 53 was rotated to advance the socket inner cylinder 30 forward. Thus, the socket inner cylinder 30 is moved backwards relative to the socket outer diameter 40. The rear end portion 61 of the stopper 60, which was located to a position to prevent downward motion of the lock ring 44, is moved by the annular projection 37 provided on the outer peripheral surface of the socket inner cylinder 30 to the rearmost position shown in FIG. 5. Accordingly, the front end portion 64 is retreated to release the restriction of the motion of the lock ring 44. If the pushing portion 45 of the lock ring 44 is pushed down, the locking of the engaging portion 46 and annular groove 17 is released and the socket 20 can be smoothly removed from the plug 10. Once the front end portion 13 of the plug cylinder 14 is moved out of the annular space 38, the stopper 70 is urged radially inwards by the force of the plate spring 73. Since the socket inner cylinder 30 has already been retreated to the rearmost position shown in FIG. 5, the stopper 70 is engaged with the annular projection 37 as shown in FIG. 5 once again.

As has been described above, in FIG. 5, the stepped portion 72 of the stopper 70 is engaged with the annular projection 37 provided on the outer peripheral surface of the socket inner cylinder 30, the socket inner cylinder 30 is stopped in the rearmost position relative to the socket outer cylinder 40. Accordingly, the cutter section 34 is surrounded by the cover ring 42 and protected from the outside, and therefore the cutter section 34 is not damaged.

According to the coupling of the present invention, the socket 20 engageable with the plug 10 comprises the socket outer cylinder 40 and the socket inner cylinder 30 which is engaged with the smaller-diameter portion of the outer cylinder 40 and is axially movable forward and backward within the outer cylinder 40. Thereby, unsmoothness of the coupling operation due to a sliding resistance of the O-ring 36 can be eliminated, and the plug 10 and socket 20 can easily be coupled.

Since the stoppers (60 and 70) are provided within the annular space 38 defined between the socket inner cylinder 30 and socket outer cylinder 40, the socket inner cylinder 30 can move forward within the annular space 38 relative to the socket outer cylinder 40 only at the time of coupling. Therefore, the tip portion of the cutter section can be protected effectively.

What is claimed is:

1. A coupling comprising:

a plug having an engaging groove in an outer peripheral surface of a plug cylinder, the groove being engageable with lock means, and a thin film for sealing an opening, the plug being connected to a container; and a socket including a socket outer cylinder having lock means straddling an axis of the socket and being slidable in a direction perpendicular to the axis of the socket to engage with the engaging groove; and a socket inner cylinder being axially movable within the socket outer cylinder, said socket inner cylinder comprising a cutter section, having a liquid passage hole and provided on a front end portion of the socket inner cylinder, for breaking the thin film when the plug is connected to the socket, another liquid passage hole provided in rear of the cutter section, liquid passageway forming means provided in rear of said another liquid passage hole, and an O-ring, provided on an outer peripheral surface of the socket inner cylinder, for maintaining sealing between an inner peripheral surface of the plug cylinder and the outer peripheral surface of the socket inner cylinder, wherein said socket inner cylinder is engaged with a smaller-diameter rear portion of the socket outer cylinder, and is movable within the socket outer cylinder while being rotated, two stoppers are formed between the socket inner cylinder and the socket outer cylinder and situated within an annular space for engagement with the plug cylinder, one of the stoppers restricts forward movement of the socket inner cylinder relative to the socket outer cylinder, in the state in which the socket is separated from the plug, the other of the stoppers moves forward in accordance with the forward movement of the socket inner cylinder relative to the socket outer cylinder, in the state in which the socket is connected to the plug, thereby fixing the lock means, and the plug cylinder of the plug is engaged with the annular space of the socket, whereby the plug is connected to the socket.

2. The coupling according to claim 1, wherein in the state in which the plug is separated from the socket, said one of the stoppers is engaged between an annular projection formed on the outer peripheral surface of the socket inner cylinder and a reduced-diameter portion formed on the socket outer cylinder, and the other stopper is engaged between the annular projection and the lock means.

3. The coupling according to claim 1, wherein the socket inner cylinder has a rear portion which is provided with a larger-diameter portion for a manual operation and is formed as one piece with an operational cylinder.

4. The coupling according to claim 1, wherein the socket inner cylinder has a rear end portion coupled to suction means, and in the state in which the socket is connected to the plug, the passageway forming means comprises a check valve which retreats by a pressure of a fluid incoming from the container or a negative pressure created by the operation of the suction means or both.

5. A coupling comprising:

a plug having an engaging groove in an outer peripheral surface of a plug cylinder, the groove being engageable with lock means, and a thin film for sealing an opening, the plug being connected to a container: and a socket including a socket outer cylinder having lock means straddling an axis of the socket and being slidable in a direction perpendicular to the axis of the socket to engage with the engaging groove; and a socket inner cylinder being axially movable within the socket outer cylinder;

said socket inner cylinder comprising a cutter section, having a liquid passage hole and provided on a front end portion of the socket inner cylinder, for breaking the thin film when the plug is connected to the socket;

another liquid passage hole provided in rear of the cutter section;

liquid passageway forming means provided in rear of said another liquid passage hole; and an O-ring, provided on an outer peripheral surface of the socket inner cylinder, for maintaining sealing between an inner peripheral surface of the plug cylinder and the outer peripheral surface of the socket inner cylinder, wherein said socket inner cylinder is engaged with a smaller-diameter rear portion of the socket outer cylinder, and is movable within the socket outer cylinder while being rotated, and the plug cylinder of the plug is engaged with the annular space of the socket, whereby the plug is connected to the socket.

* * * * *